US010738466B1

(12) United States Patent
Boyce

(10) Patent No.: US 10,738,466 B1
(45) Date of Patent: Aug. 11, 2020

(54) DEMOUNTABLE WALL SYSTEM

(71) Applicant: Boyce Products, Ltd., Damascus, PA (US)

(72) Inventor: David L. Boyce, Damascus, PA (US)

(73) Assignee: Boyce Products Ltd., Damascus, PA (US)

( * ) Notice: Subject to any disclaimer, the term of this patent is extended or adjusted under 35 U.S.C. 154(b) by 0 days.

(21) Appl. No.: 16/141,333

(22) Filed: Sep. 25, 2018

Related U.S. Application Data

(60) Provisional application No. 62/563,277, filed on Sep. 26, 2017.

(51) Int. Cl.
*E04B 2/74* (2006.01)
*E04B 2/78* (2006.01)
*E04B 2/76* (2006.01)

(52) U.S. Cl.
CPC ..... *E04B 2/74* (2013.01); *E04B 2/7407* (2013.01); *E04B 2/7425* (2013.01); *E04B 2/7433* (2013.01); *E04B 2/76* (2013.01); *E04B 2/78* (2013.01); *E04B 2/789* (2013.01); *E04B 2/7863* (2013.01); *E04B 2/7872* (2013.01); *E04B 2002/7461* (2013.01)

(58) Field of Classification Search
CPC .. E06B 1/702; E06B 2001/628; E04B 2/7453; E04B 2/7407; E04B 2/74; E04B 2002/7487; E04B 2/7425; E04B 2/7433; E04B 2/744; E04B 2002/7461; E04B 2/76; E04B 2/78; E04B 2/7809; E04B 2/7818; E04B 2/7827; E04B 2/7836; E04B 2/7854; E04B 2/7863; E04B 2/7872; E04B 2/789; E04B 2/82
See application file for complete search history.

(56) References Cited

U.S. PATENT DOCUMENTS 3,333,382 A * 8/1967 De Ridder ..... E06B 1/16 52/771
3,559,357 A 2/1971 Lowe ..... 52/282
3,866,364 A 2/1975 Pollard ..... 52/36
4,073,113 A * 2/1978 Oudot ..... E04B 1/24 52/710
4,434,900 A 3/1984 Cook ..... 211/189
4,709,517 A 12/1987 Mitchell et al. ..... 52/36
5,069,263 A * 12/1991 Edwards ..... A47G 5/00 160/135
5,155,955 A 10/1992 Ball et al. ..... 52/126.4
5,634,300 A 6/1997 Huebner et al. ..... 52/36.1
(Continued)

*Primary Examiner* — Andrew J Triggs
(74) *Attorney, Agent, or Firm* — MacCord Mason PLLC

(57) ABSTRACT

A demountable wall system. The system includes a plurality of framing members including a horizontal lower framing member having upper and lower slots, a horizontal upper framing member having upper and lower slots, and vertical framing members having opposed side slots. At least one vertical rectangular panel has a lower edge inserted into the upper slot of the lower member, an upper edge inserted into the lower slot of the upper member, and side edges inserted into facing slots of the side members. A mounting member has opposed sides, an upper edge and a lower edge, the upper edge being fitted into the lower slot of the lower member. Finally, a panel trim assembly comprising a panel trim may be installed onto each edge of the vertical rectangular panel.

37 Claims, 7 Drawing Sheets

(56) References Cited

U.S. PATENT DOCUMENTS

| | | | | |
|---|---|---|---|---|
| 5,758,466 | A | 6/1998 | Tucker | 52/586.2 |
| 5,864,997 | A | 2/1999 | Kelly | 52/282.2 |
| 6,006,480 | A | 12/1999 | Rook | 52/309.12 |
| 6,170,211 | B1 * | 1/2001 | Boyce | E04B 2/7453 160/135 |
| 7,249,624 | B2 * | 7/2007 | Zeh | A47B 83/001 160/350 |
| 8,833,016 | B2 * | 9/2014 | Reifer | E04B 2/967 52/235 |
| 9,382,710 | B1 * | 7/2016 | Diaz | E04B 2/7416 |

* cited by examiner

DEMOUNTABLE WALL SYSTEM

BACKGROUND OF THE INVENTIONS

(1) Field

The present inventions relate generally to demountable walls for building partitions having the appearance of a permanently installed, floor-to-ceiling wall and, in particular, to a demountable wall system that can readily assembled, wired, and disassembled using a minimal number of standard components.

(2) Related Art

Modern offices frequently require rearrangement of office space in order to address changing personnel needs and different interactions between personnel resulting from changes in the company's strategic direction. Also, many offices are in rented spaces where the management will desire to minimize the cost of significant upfitting when the office may be moved to another location. At the same time, there is a desire for an office that will be attractive both to employees and visitors.

A common way of addressing these needs is through the use of moveable, full-height partitions that can be readily rearranged into offices, workstations or cubicles. In many instances, however, greater privacy as well as improved aesthetics is desired. Therefore, the industry has also developed moveable or demountable wall systems that more closely approximate the appearance and privacy afforded by permanent floor-to-wall structures or millwork.

For example, U.S. Pat. No. 5,155,955 to Ball et al. describes a wall system in which a plurality of panels or other structural rectangular frames are joined to create a wall that extends to above door height and includes a lockable door. The side edges these frames are attached to upright connecting members, and the top of the wall is covered with an enlarged cornice providing a location for wiring and lighting. The lower ends of the upright members include adjustable feet to level the wall.

U.S. Pat. No. 4,709,517 to Mitchell et al. describes a floor-to-ceiling wall system comprised of a ceiling channel attached to the ceiling, a floor channel attached to the floor and vertical studs connecting the ceiling and floor channels. The wall system also includes horizontal stringers joining the studs, and panels attached to the stud surfaces. However, these and other prior art demountable wall systems require considerable steps in assembly and disassembly, including the fastening together of numerous parts, as well as attachment to the ceiling and/or the floor. Moreover, the wall systems require essentially custom manufacture to fit the desired space, substantially increasing their cost and decreasing their utility when it is desired to move the wall to another location. Also, the walls often have the appearance of temporary structure instead of permanent walls. Thus, there is a continuing need for an aesthetically pleasing wall system that can be readily assembled and disassembled using a minimal number of components. There is also the need for a wall system that has the appearance of a permanent floor-to-ceiling wall without the necessity of attaching the wall to the ceiling or to the floor.

SUMMARY OF THE INVENTIONS

The present inventions are directed to a demountable wall system including a plurality of framing members including a horizontal lower framing member having upper and lower slots, a horizontal upper framing member having upper and lower slots, and vertical framing members having opposed side slots. At least one vertical rectangular panel has a lower edge inserted into the upper slot of the lower member, an upper edge inserted into the lower slot of the upper member, and side edges inserted into facing slots of the side members. A mounting member has opposed sides, an upper edge and a lower edge, the upper edge being fitted into the lower slot of the lower member. Finally. a panel trim assembly comprising a panel trim may be installed onto each edge of the vertical rectangular panel, wherein a lower edge of the panel trim assembly is inserted into the upper slot of the lower member, an upper edge of the panel trim assembly inserted into the lower slot of the upper member, and side edges of the panel trim assembly inserted into facing slots of the side members.

The demountable wall system may further include a structural grid assembly fitted into the upper slot of the upper member adapted to increase the stability of the wall system. In one embodiment, the structural grid assembly is comprised of an extrusion with contoured grooves on an exterior surface and on an interior surface of the extrusion, the contoured grooves adapted to receive an attachment. The extrusion may be comprised of three extruded aluminum profiles including two side extrusions and a bottom extrusion. Also, the attachment may be a decorative cladding attached to the contoured grooves on the exterior surface of the extrusion. In one embodiment, the attachment is a panel track attached to the contoured grooves on the interior surface of the extrusion.

The demountable wall system may further include a sliding panel having an upper edge inserted into the panel track, the sliding panel having an open configuration and a closed configuration wherein the sliding panel moves between the open configuration and the closed configuration by sliding parallel with respect to a horizontal framing member. The demountable wall system may further include a panel filler for attaching the sliding panel to the framing member.

The demountable wall system may further include a panel guide adapted to retain the sliding panel on the panel track and prevent the sliding panel from tilting when sliding between the open configuration and the closed configuration. The panel guide may be attached to the mounting member.

The demountable wall system may further include a wiring conduit adapted for concealing wires. The wiring conduit may be comprised of an aluminum box for housing wires. In one embodiment, the demountable wall system further include a clip attachment for attaching the mounting member onto the wiring conduit.

The demountable wall system may further includes an opening on the mounting block adapted to connect with the mounting block. It may further include a mating slug on the connection flange adapted to be inserted into the opening of the mounting block. In one embodiment, the mating slug is secured into the opening with a pin.

The demountable wall system also may further include a center post adapted to connect at least two of the framing members. In one embodiment, the mounting block and the backer plate are installed on one framing member and the connection flange is installed on another framing member or on the center post, the mounting block and the connection flange adapted to connect one framing member to another framing member or to the center post. The mounting block and the backer plate may also be installed on a horizontal framing member. The connection flange may be installed on the center post. In one embodiment, the center post comprises four faces whereby at least two faces each include one connection flange.

In one embodiment, the plurality of framing members are H-shaped.

The demountable wall system may further include horizontal cover plates releasably attached to the opposed sides of the mounting member.

In one embodiment, the demountable wall system further includes a wall panel inserted into the panel trim assembly. The wall panel may be comprised of glass having outer edges inserted into slots of said panel trim assembly. In another embodiment, the wall panel is comprised of a rectangular outer frame, the frame having outer edges inserted into slots of the panel trim assembly, and a center section mounted in the outer frame. The rectangular outer frame may be wood and the center section may be glass.

In one embodiment, the wall panel is comprised of an upper panel section having a lower edge and a lower panel section having an upper edge, the wall further including an intermediate horizontal framing member with opposed upper and lower slots between the upper and lower panel sections, the lower edge of the upper panel section being inserted into the upper slot of the intermediate framing member, and the upper edge of the lower panel section being fitted into the lower slot of the intermediate framing member.

The demountable wall system may further includes detachable cover plate over the vertical corner framing member.

In one embodiment, the vertical rectangular panel may be a wood panel.

In another embodiment, each panel trim comprises a first trim member and a second trim member. The first trim member may be mounted on a framing member. Also, each of the framing members may have cross-sections comprising a first member and a second member adapted to combine longitudinally and form the framing member wherein the vertical rectangular panel may be inserted in between the first member and the second member of the framing member and the vertical rectangular panel may be removed from the framing member by separating the first member and the second member.

The mounting member may mounted to the vertical frame member. The mounting member may be mounted to the vertical frame member with a filler piece of wood. The second trim member may be mounted on the vertical rectangular panel.

Accordingly, one aspect of the present inventions is to provide a demountable wall system including (a) a plurality of framing members including a horizontal lower framing member having upper and lower slots, a horizontal upper framing member having upper and lower slots, and vertical framing members having opposed side slots; (b) at least one vertical rectangular panel having a lower edge inserted into the upper slot of the lower member, an upper edge inserted into the lower slot of the upper member, and side edges inserted into facing slots of the side members; and (c) a mounting member having opposed sides, an upper edge and a lower edge, the upper edge being fitted into the lower slot of the lower member, and (d) a panel trim assembly comprising a panel trim installed onto each edge of the vertical rectangular panel, wherein a lower edge of the panel trim assembly is inserted into the upper slot of the lower member, an upper edge of the panel trim assembly inserted into the lower slot of the upper member, and side edges of the panel trim assembly inserted into facing slots of the side members.

Another aspect of the present inventions is to provide a demountable wall system including (a) a plurality of framing members including a horizontal lower framing member having upper and lower slots, a horizontal upper framing member having upper and lower slots, and vertical framing members having opposed side slots; (b) at least one vertical rectangular panel having a lower edge inserted into the upper slot of the lower member, an upper edge inserted into the lower slot of the upper member, and side edges inserted into facing slots of the side members; (c) a mounting member having opposed sides, an upper edge and a lower edge, the upper edge being fitted into the lower slot of the lower member; (d) a panel trim assembly comprising a panel trim installed onto each edge of the vertical rectangular panel, wherein a lower edge of the panel trim assembly is inserted into the upper slot of the lower member, an upper edge of the panel trim assembly inserted into the lower slot of the upper member, and side edges of the panel trim assembly inserted into facing slots of the side members; and (e) a connection system for attaching the framing members comprising a mounting block, a backer plate adapted to attach to the mounting block, and a connection flange adapted to connect with the mounting block.

Still another aspect of the present inventions is to provide a demountable wall system including (a) a plurality of framing members including a horizontal lower framing member having upper and lower slots, a horizontal upper framing member having upper and lower slots, and vertical framing members having opposed side slots; (b) at least one vertical rectangular panel having a lower edge inserted into the upper slot of the lower member, an upper edge inserted into the lower slot of the upper member, and side edges inserted into facing slots of the side members; (c) a mounting member having opposed sides, an upper edge and a lower edge, the upper edge being fitted into the lower slot of the lower member; (d) a panel trim assembly comprising a panel trim installed onto each edge of the vertical rectangular panel, wherein a lower edge of the panel trim assembly is inserted into the upper slot of the lower member, an upper edge of the panel trim assembly inserted into the lower slot of the upper member, and side edges of the panel trim assembly inserted into facing slots of the side members; and (e) a structural grid assembly fitted into the upper slot of said upper member adapted to increase the stability of the wall system.

A unique feature of the inventions is that in many conditions, the wall components are not fastened to each other except at the wall ends and corners. That is, the upper and lower ends of the intermediate vertical frame members merely abut and interlock between panels and the upper and lower horizontal framing members, while the panel members are merely inserted into the facing slots of framing members.

Each H-shaped member used to frame the wall panels includes opposed panel-receiving slots or grooves, sized to receive the wall panels. That is, the thickness of the wall panel will be approximately the same dimension as the slot width, so that the panel can be inserted into the slot. Each H-member preferably includes an inverted tapered interior profile to create a dovetail-like shaped slot in the final assembly. The dovetail-like slot accommodates mating profiled spacers that roll directly into the H-members slots thus eliminating secondary panel frame when desired. Thinner panels such as glass can be accommodated directly in the H-member profiles with the addition of a roll-in spacer profile. The roll-in spacer profile is removable and preferably matching wood. The described slot in the H-member accommodates both rectangular and tapered profiles due to inverted shape.

Since all of the framing members can be of the same cross-sectional shape, it is possible to cut all members with the same settings on the saw or other equipment, and then simply cut the members to a desired length. Moreover, due to the manner is which the walls are constructed, the members can be cut to standard lengths that are useful under a variety of conditions. Additionally, members can be fit and modified in the field to accommodate site conditions.

The wall is constructed by inserting the lower edges of each vertical panel in the upper slot of the horizontal lower framing member. The sides of each panel are fitted into facing slots of vertical framing members, and the top ends of the panels are capped by inserting the upper edges of the panels into the lower slot of a horizontal upper framing member. The H-shaped members can include one removable side to accommodate easy replacement of panels with minimal dismantling.

In order to hide the adjustable feet and simulate the appearance of a wall that is permanently affixed to the floor, the outer and inner faces of the mounting plate may be covered with detachable side members or plates. Each side plate may be of a horizontal cross-section with a height approximately equal to, or slightly less than, the height of the horizontal lower H-shaped member. The plates may be releasably attached to the outer and inner faces of the lower H-shaped member with suitable fasteners. Furthermore, additional base profile can be provided with project to be applied to building structure walls to simulate a permanently installed appearance.

Adjustable threaded set screws are secured to the bottom of the elongated horizontal member, and are vertically adjustable to move the plate upward so that upper surface of the horizontal plate engages the ceiling, preferably with an intermediate foam gasket. Thus, the wall will have the appearance of a permanent wall, although the wall is not actually fastened to the ceiling. The relationship between elongated horizontal member and H-shaped member also allows for accommodating out of level site conditions.

The end of a demountable wall of the present inventions can be attached to a permanent building wall by fastening an elongated vertical member having a width substantially equal to a slot width to the building wall. An H-shaped member is then slipped over or may be fastened to the elongated vertical member, and the wall is formed as noted above. The relationship between elongated vertical member and H-shaped member also allows for shimming and accommodating out of plumb site conditions.

Instead of using a single panel between vertical framing members, the panel can be formed of upper and lower panel sections by the positioning of an intermediate horizontal H-shaped member with upper and lower slots between the upper and lower panel sections. In this construction, the upper panel section will have an upper edge inserted into the lower slot of the upper horizontal H-shaped member, and the upper edge of the lower panel section will be inserted into the lower slot of the intermediate H-shaped member. The lower panel section will have upper and lower edges inserted into the lower slot of the intermediate H-shaped member, and the lower slot of the lower H-shaped member, respectively. It will be understood that a wall system may include a combination of one-piece and multi-section panels or different panel materials.

In addition, it will be noted that the wall systems are formed of only a few kinds of components, i.e., a plurality of H-shaped members, panels, similar elongated horizontal/vertical members, base profile, posts, and a universal connection assembly used throughout the system. Thus, the wall system is relatively simply to manufacture, and the components can be arranged in a variety of configurations.

These and other aspects of the present inventions will become apparent to those skilled in the art after a reading of the following description of embodiments when considered with the drawings.

DESCRIPTION OF THE EMBODIMENTS

Figure 1:
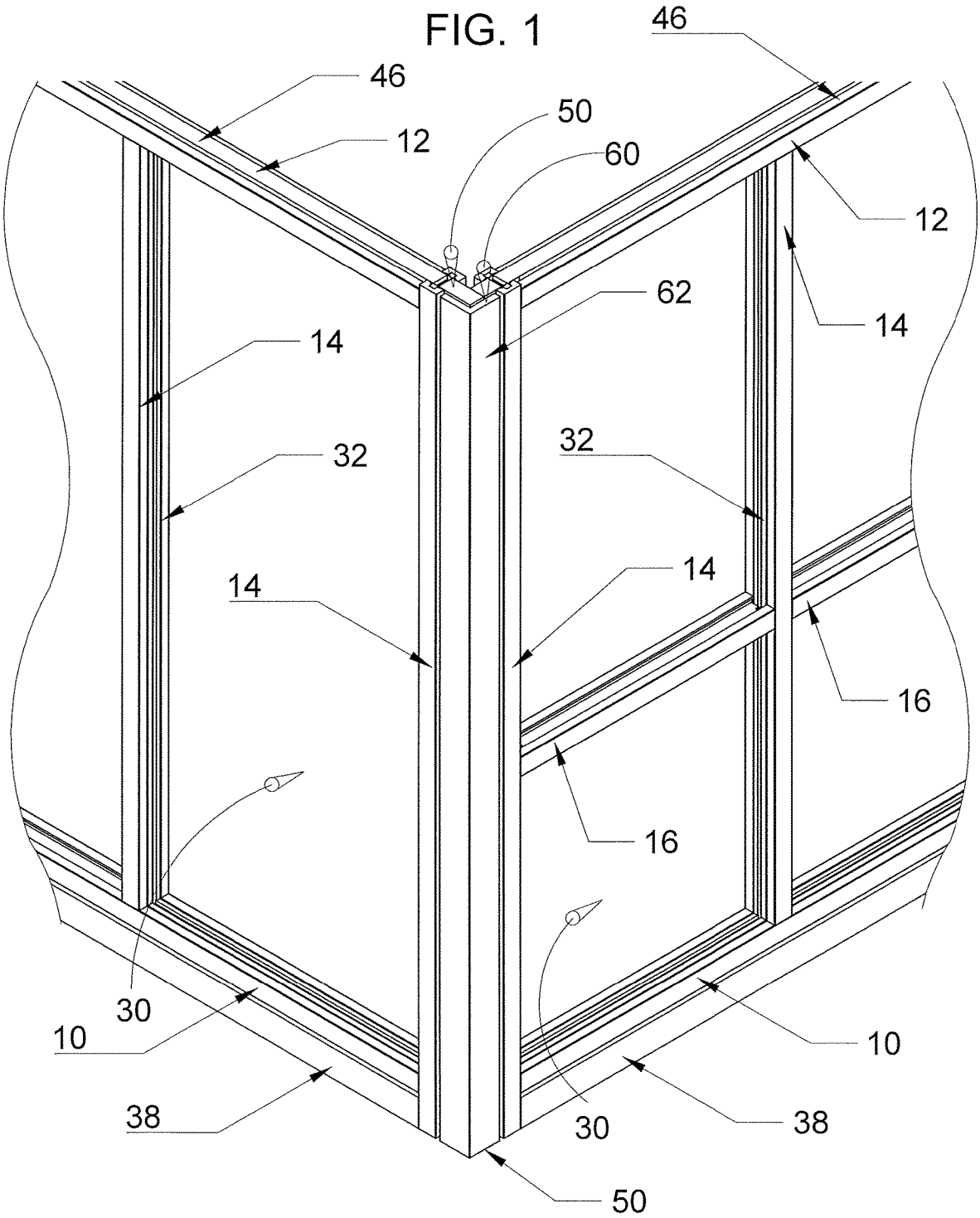
FIG. 1 is a front perspective view of a demountable wall system showing a corner cover style construction according to one embodiment of the present inventions

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the inventions and are not intended to limit the inventions thereto. As best seen in FIG. 1, a demountable wall system is shown constructed according to the present inventions. The demountable wall system may include a plurality of framing members, i.e., lower horizontal H-shaped members 10; upper horizontal H-shaped members 12; and vertical H-shaped connecting members 14. Intermediate horizontal H-shaped framing members 16 also form a part of the frame of the preferred embodiment. In one embodiment, all H-shaped framing members, as well as other framing members, are formed from wood. Members 10-16 all have the same cross-sectional shape and dimensions as illustrated in FIGS. 4-8.

The wall system also may include vertical rectangular panels, generally 30. While panels may be of different constructions to meet design criteria, such as the need for privacy, the panels illustrated in one embodiment are comprised of a multi-section, slotted outer, wooden frame 32 and an inner glass panel 34 fitted into frame 32. Frame 32 has a width substantially equal to the width of the slots 26 and 28 in the framing members. In other embodiments, the wall panel is comprised of any interchangeable panel material such as glass having outer edges inserted into slots of said panel trim assembly.

Figure 2:
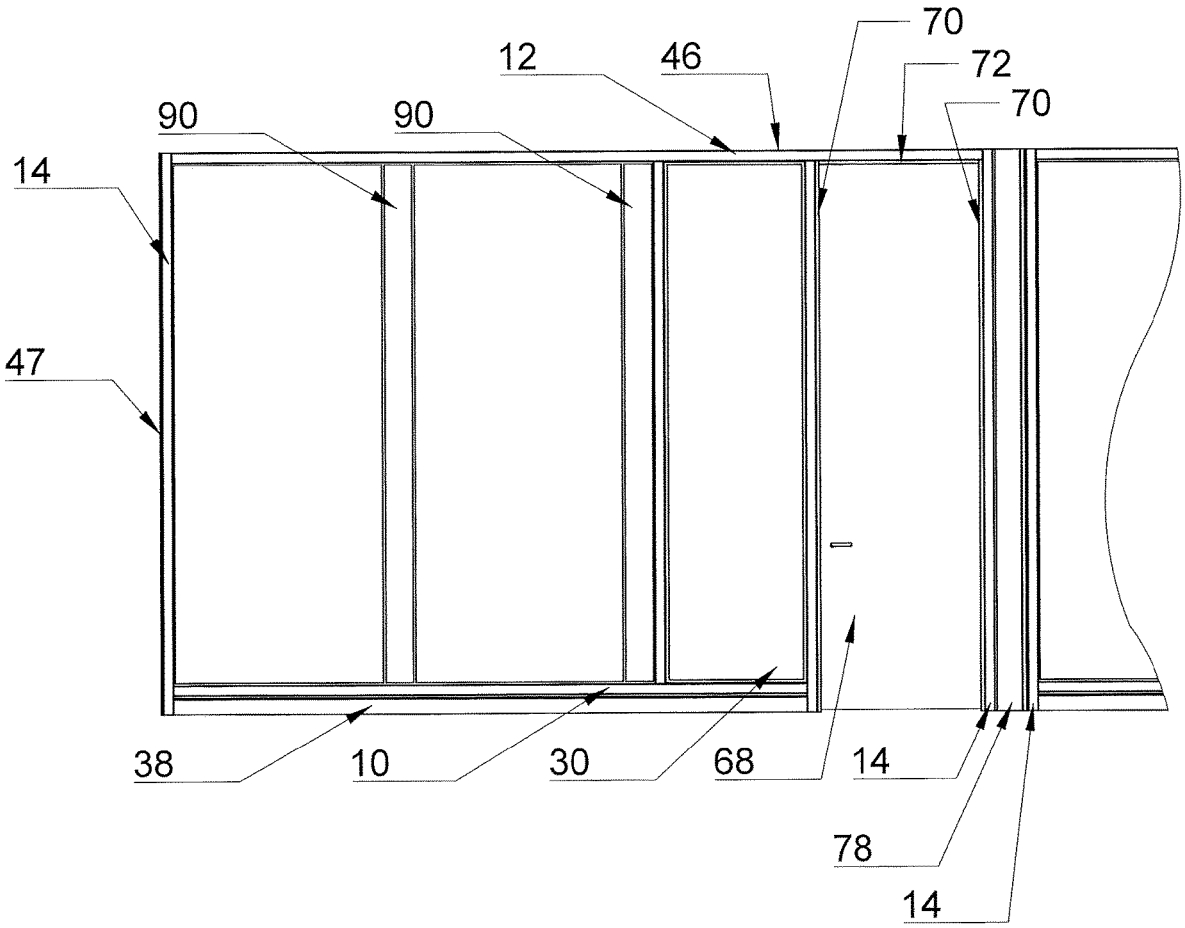
FIG. 2 is a side elevation view of a wall with a panel and a door constructed according to one embodiment of the present inventions.
Figure 3:
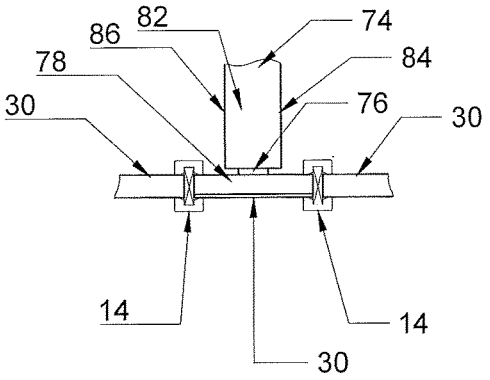
FIG. 3 is a top plan view of the attachment of a second wall between the ends of a first wall constructed according to one embodiment.

As illustrated in FIGS. 1-3, the lower ends of panels 30 are fitted into the upper slot of horizontal lower framing member 10. Vertical framing members 14 are positioned on either side of panels 30, with the side edges of panel 30 being fitted into slots in members 14. The top edges of panels 30 are capped by inserting the top edges into the lower slot of upper framing member 16.

Horizontal mounting member 34, which has a generally rectangular cross-section and a width substantially equal to the width of the framing member slots, is used to support the wall system on a floor or other horizontal surface. The upper end of member 34 is fitted into the lower slot of lower framing member 10. Vertically adjustable mounting feet 36 are secured to the lower surface of member 34 to engage a floor surface to compensate for any floor variation and to level the wall. Member 34 can be formed of a plurality of stacked segments, permitting one or more of the segments to be removed to adjust for significant floor unevenness.

Detachable side plates 38 and 40 are releasably attached to the outer faces of mounting member 34 with connectors 42 and 44, respectively, to hide feet 36 and simulate the appearance of a permanent wall. To simulate a wall that is permanently attached to the ceiling, a vertically adjustable member comprised of a horizontal plate 46 with adjustable feet 48, is mounted in the upper slot of the upper framing member 14 to adjustably close the opening between the top of the wall and a ceiling (C). A gasket 49 will normally be positioned between the ceiling and the top of the wall.

In the embodiment shown in FIG. 1, the joining of two walls meeting at a 90° corner utilize a vertically-oriented L-shaped connecting member 50 fastened into the outer slots of corner framing members 12 at the ends of each wall. L-shaped connecting member 52 is constructed of a first section 54 axially aligned with one of the walls and a second section 56 axially aligned with the other wall. Section 54 has a distal end inserted into the outer slot of corner framing member 52 of the first wall and a proximal end. Section 56 has a distal end inserted into the facing slot of corner framing member 52 on the other wall and a proximal end integral with the proximal end of section 54. Fasteners 58 may be used to secure L-shaped connecting member 50 to corner framing members 52.

An outer vertically-oriented, L-shaped cover plate 60 may be releasably fitted over connecting member 50 to hide fasteners 58 and to give the appearance of a permanent wall. Cover plate 60 is comprised of a first section 62 parallel to the first wall and a second section 64 parallel to the second wall. The proximal ends of sections 62 and 64 are integrally joined at a 90° angle. Releasable connectors 66 join the inner walls of sections 62 and 64 to cover plate 60.

Figure 1A:
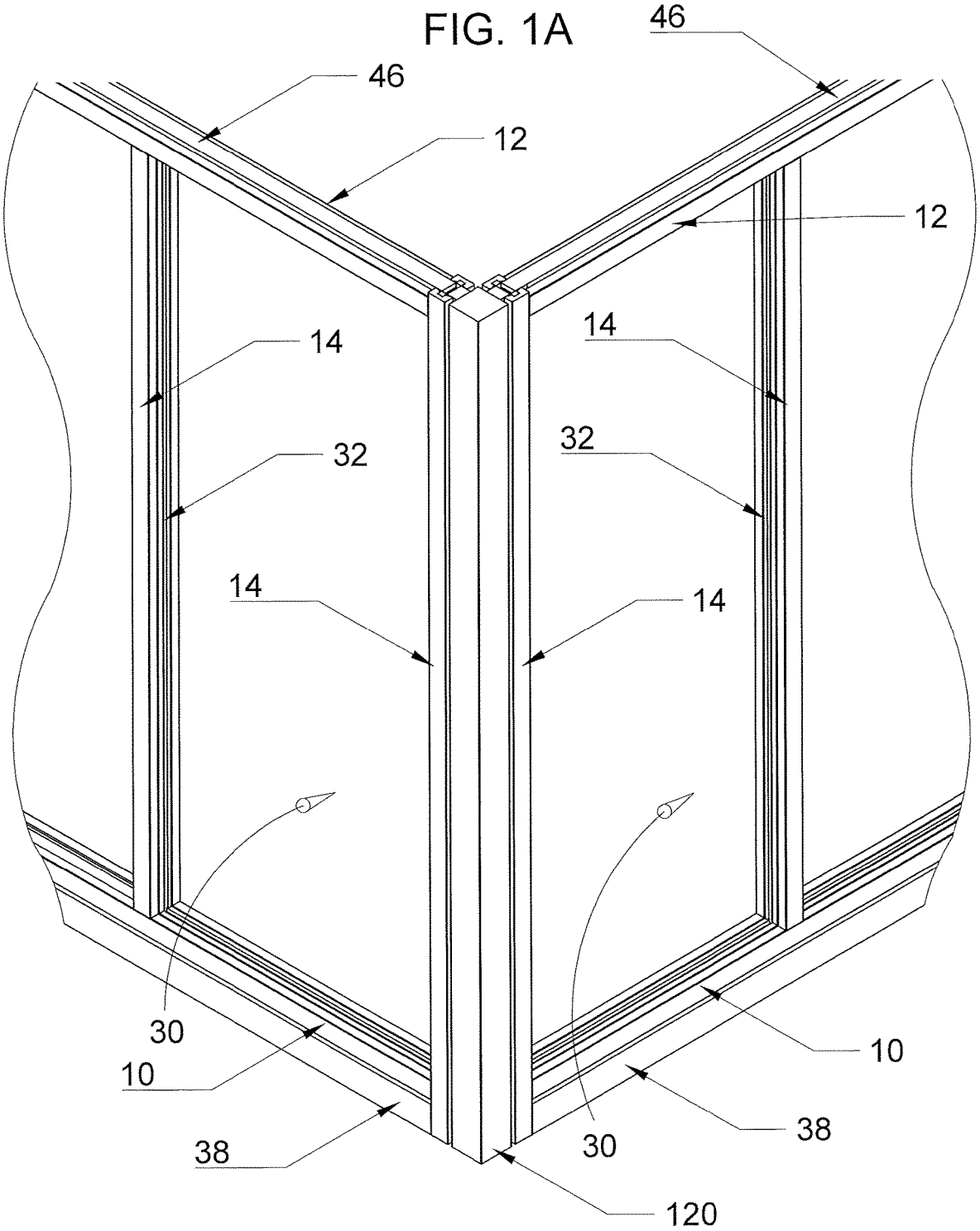
FIG. 1A is a front perspective view of an improved demountable wall system having a center post constructed according to one embodiment of the present inventions.

FIG. 1A depicts another embodiment of the present inventions, wherein the two walls are adjoined to a center post 120. Each face of center post 120 includes a connector (see FIGS. 11 and 11A and accompanied discussion below) for attaching to a framing member. The center post 120 may be used as a starting position for assembling a plurality of walls.

Figure 8:
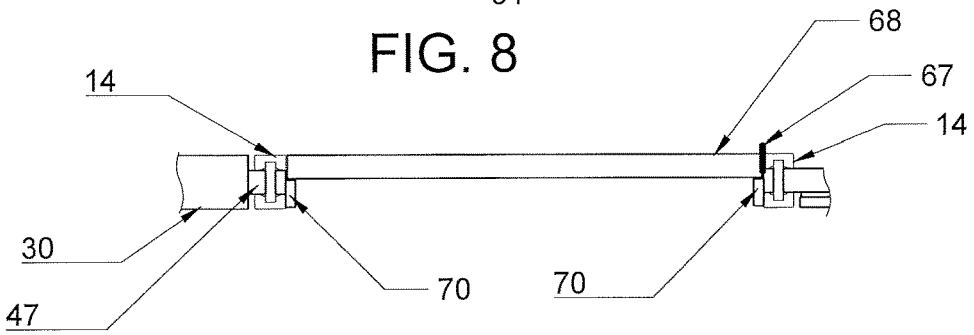
FIG. 8 is a detailed sectional top plan view of the mounting of a door in the wall system constructed according to one embodiment.

As best illustrated in FIGS. 2 and 8, a door 68 can be mounted between two framing members 14 by inserting side jamb attachment plates 70 into the facing slots of spaced members 14, and a top jamb attachment plate 72 into the lower slot of the upper horizontal framing member 12.

Figure 4:
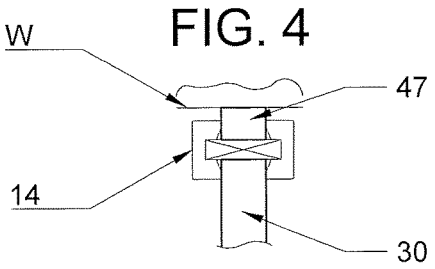
FIG. 4 is a top plan view of the end of a wall attached to a permanent wall.
Figure 9:
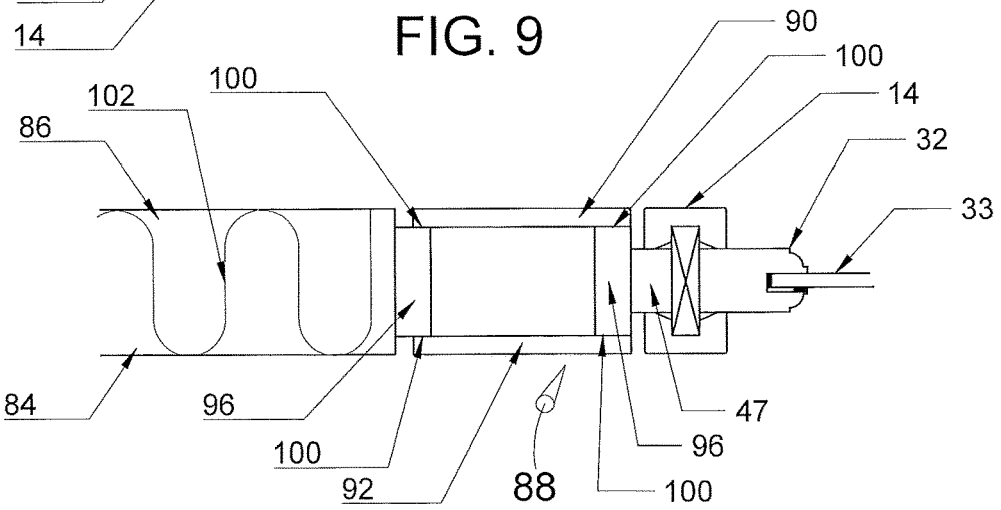
FIG. 9 is a detailed sectional top plan view of the mounting of an acoustic panel wiring cavity in the wall system.

As best illustrated in FIG. 3, a second wall 74 can be attached at a 90° angle to a first wall intermediate the ends of the first wall using a T-shaped connecting member 76 formed of a first section 78 having opposed ends fitted into facing slots of floor-to-ceiling end framing members 80, and a second section 82 extending at a 90° angle from the center of section 78. The second wall may be of the same construction as the first wall or of a different construction. For example, as illustrated, the second wall is comprised of a pair of spaced acoustical panels 84 and 86 attached to section 82. The interior space between panels 84 and 86 may be hollow or filled with insulation. As illustrated in FIG. 9, a portion of the space may be used for electrical or utility wiring. As illustrated in FIG. 4, the end of a wall may be attached to a permanent wall (W), such as the side of a room, with a vertical mounting plate secured to the wall (W), and an end framing member secured to mounting plate.

FIG. 9 also illustrates the insertion of a wiring conduit 88 into a wall. Conduit 88 is comprised of spaced outer walls 90 and 92 on either sides of connecting members 96 and 98. Walls 90 and 92 may be attached with hook-and-loop fasteners 100, or other releasable fasteners for ready access to the interior 94 of conduit 88. Members 96 and 98 joining conduit 88 can be used to join the conduit to the end of a panel 30, or to a hollow wall section filled with an insulating material 102.

Figure 2A:
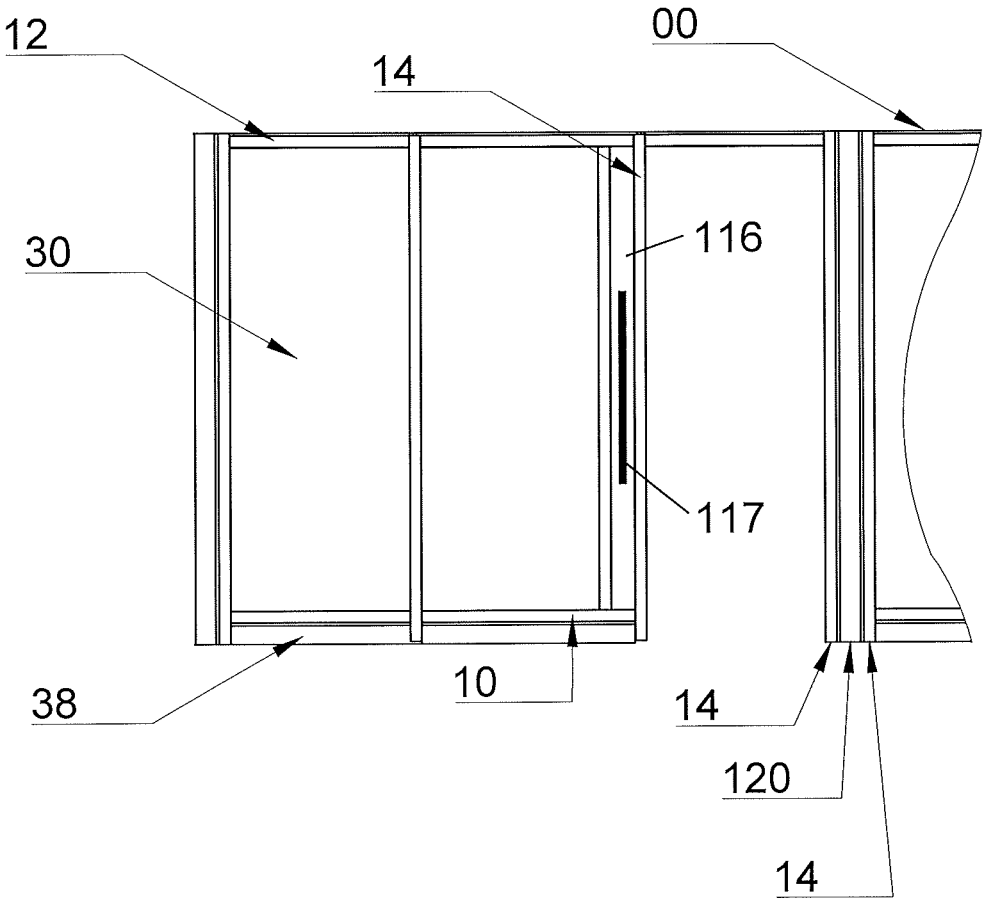
FIG. 2A is a side elevation view of a wall with a panel and a sliding panel constructed according to another embodiment.

FIG. 2A shows another embodiment of the present inventions, wherein sliding panels 116 are used as a substitute, or in combination with, swing doors to create openings within the wall system 10. Sliding panels 116 may also be useful for re-configuring rooms. For example, sliding panels 116 may be closed to divide a space into separate rooms, or may be opened to combine separate rooms into a single larger space. Handles 117 may also be included for sliding panels 116.

Figure 8A:
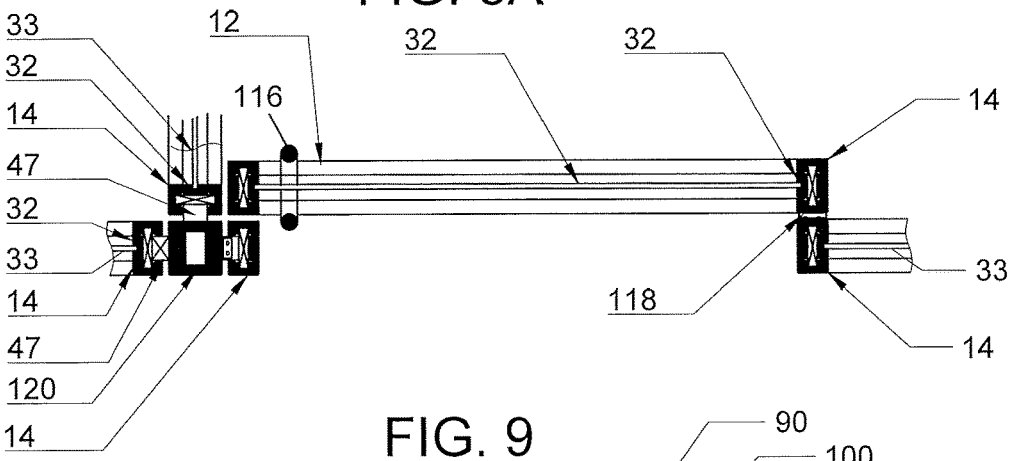
FIG. 8A is a detailed sectional top plan view of the mounting of a sliding door in the improved wall system constructed according to one embodiment.

FIG. 8A provides one example of a sliding panel 116, wherein the sliding panel 116 is installed onto a panel track 111 (one example shown in FIG. 10) thereby enabling the sliding panel 116 to slide between open and closed configurations. A panel filler is used to attach a sliding panel 116 to a framing member. To prevent the sliding panel 116 from tilting, a panel guide 118 is installed on a vertically opposing side of the panel track to retain the sliding panel 116 within the panel track 111.

Figure 10:
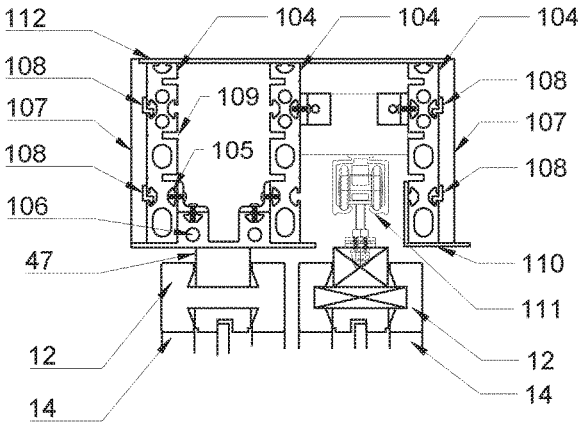
FIG. 10 is a detailed sectional end view of the upper adjustment member assembled as a new structural grid assembly with applied covers constructed according to another embodiment.

FIG. 10 illustrates one example of a structural grid assembly having a panel track 111 adapted to receive an upper edge of a sliding panel 116. The structural grid assembly comprises three structural extruded profiles, including side extrusions 104, and a bottom extrusion 106, as well as an extruded profile 109 mechanically joined left and right to create a structural box spanned between posts to support weight of sliding wall sections. The structural box assemblies are joined mechanically at perpendicular intersections to form a structural grid. A third structural extruded profile 104 profile is added in parallel to the side of structural box to form a cavity when attachment and concealing panel track 111 is desired.

Figure 10A:
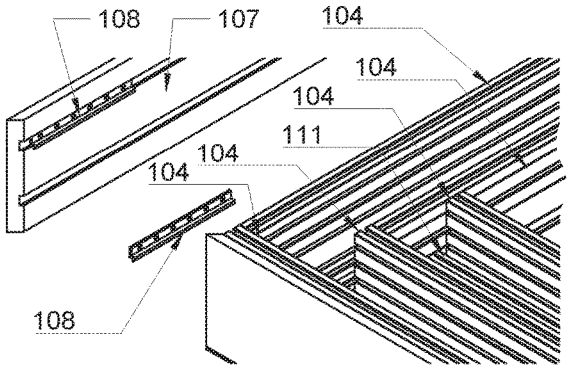
FIG. 10A is an enlarged exploded view of the new covers and upper adjustment member shown in FIG. 10.

FIGS. 10 and 10A illustrates the structural grid assembly which may be added onto the top of demountable wall systems to increase their stability with taller heights and longer spans. The structural grid assembly is comprised of multiple extruded aluminum profiles. Structural extruded profile 104 includes contoured grooves 105 to mechanically attach structural extruded profile 104 left and right. Profile 106 is the bottom which mechanically joins two structural extruded profiles 104 to create a structural box channel.

The structural extruded profile 104 may incorporate contoured grooves 105 on all four surfaces for universal attachment to structural extruded profile 106 and other components. The bottom surface of the structural extruded profile 106 extends past the structural extruded profile 104 to support drop in ceiling panels. Where a ceiling is not present, other components such as decorative covers 107 are attached to outside of structural extruded profile 104 with machined metal clips 108 which slide in/down to lock into contoured grooves 105 on the profile 104. Also the top can be covered with profile 112. The structural box channels when joined as a grid become a raceway. The structural extruded profile 104 interior surface may include slots 109 to accommodate optional partitions for separations of cavity in raceway.

Figure 11:
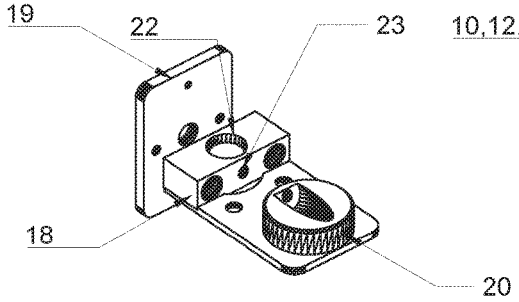
FIG. 11 is an enlarged perspective view of a new connection system for connecting framing members constructed according to one embodiment.
Figure 11A:
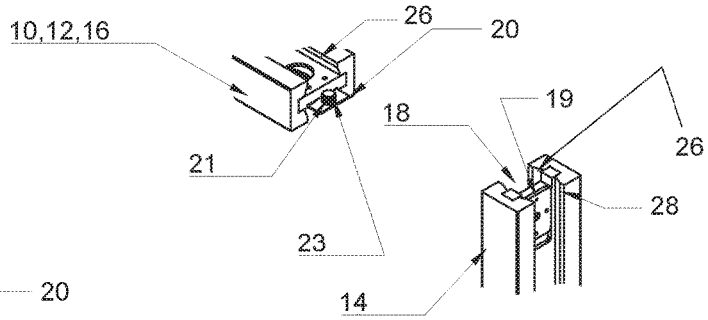
FIG. 11A is an enlarged perspective view of the new connection system shown in FIG. 11 installed onto a pair of framing members.

FIGS. 11 and 11A illustrates the structural attachment of all horizontal 10, 12 and 16 to all vertical members 14 when desired. The same machined hardware assembly may be always used. In one embodiment, the universal connection assembly is comprised of three machined and mating parts. The three parts; part one is a mounting block 18, part two is a backer plate 19 to mounting block, part one and two become an adjustable assembly within the member channels. Part three is connection flange 20 attached to the end of joining members 10,12,16 which will engage the mounting block 18 assemblies from all top, bottom, left and right directions.

Connection flange 20 may include machined surfaces including a mating slug 21 to engage a machined opening 22 on mounting block 18. A locking cross pin 23 is inserted after flange 20 slug 21 is inserted into mounting block 18 machined opening 22. The assembly of the three components remain flush in the member channels at all times to not obstruct rectangular panels. As a result, the components can be easily and quickly fitted together and separated.

Figure 3A:
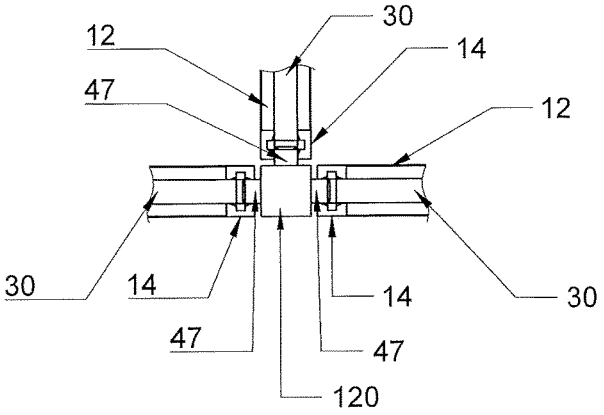
FIG. 3A is a top plan view of a center post attaching three walls constructed according to another embodiment.
Figure 5:
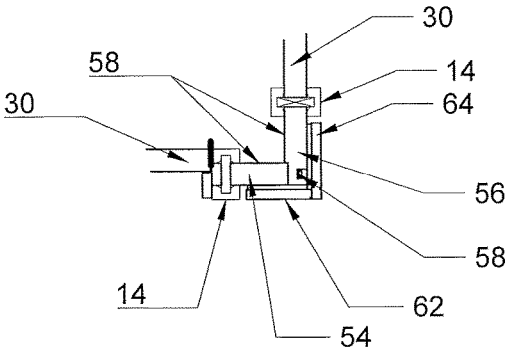
FIG. 5 is a detailed sectional top plan view of the corner connection constructed according to the embodiment shown in FIG. 1.
Figure 5A:
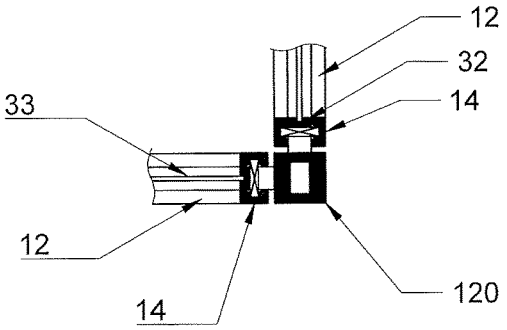
FIG. 5A is a detailed sectional top plan view of a center post connecting two walls constructed according to the embodiment shown in FIG. 1A.
Figure 6:
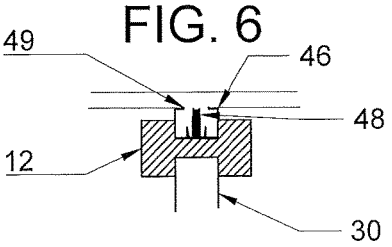
FIG. 6 is a detailed sectional end view of the upper adjustment member constructed according to one embodiment.

As best illustrated in FIGS. 3A and 5A, a center post 120 may be used to install a plurality of framing members 47. The framing members 47 include upper horizontal H-shaped members 12 and vertical H-shaped connecting members 14, and may further include thick rectangular panels 30, such as wood with acoustic insulation. Each wall may be of the same construction or of a different construction. As illustrated in FIG. 4, the end of a wall may be attached to a permanent wall (W), such as the side of a room, with a vertical mounting plate secured to the wall (W), and an end framing member secured to mounting plate. Each framing member 47 is connected to the center post using the connection assembly shown in FIGS. 11 and 11A.

Figure 7:
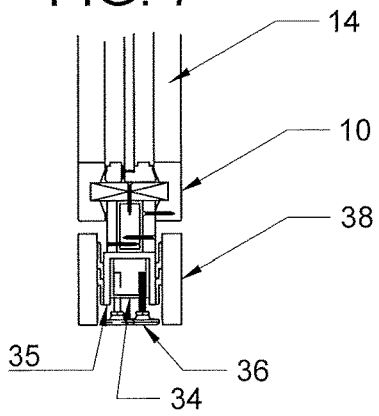
FIG. 7 is a detailed sectional end view of the lower support member.

Turning now to FIG. 7, adjustable threaded set screws 36 may be secured to the bottom of the elongated horizontal member 35 of mounting member 34, and are vertically adjustable to move the plate upward so that upper surface of the horizontal plate engages the ceiling, preferably with an intermediate foam gasket. Thus, the wall will have the appearance of a permanent wall, although the wall is not actually fastened to the ceiling.

The relationship between elongated horizontal member and H-shaped member also allows for accommodating out of level site conditions. A cladding 38 may be attached to the mounting member using a clip attachment 122.

Figure 12:
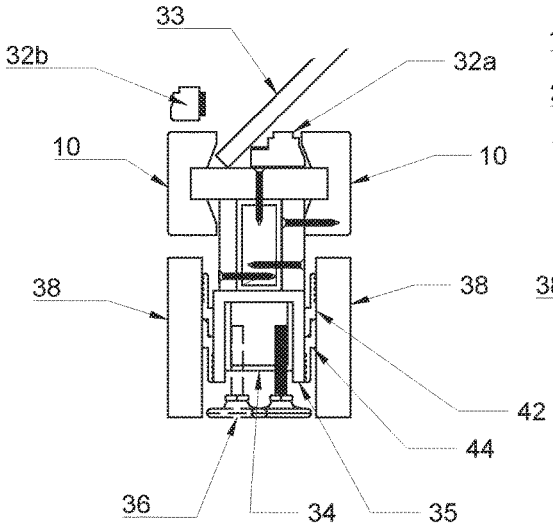
FIG. 12 is a detailed sectional end view of the improved demountable wall system with the panel being removed from the lower support member constructed according to one embodiment.
Figure 12A:
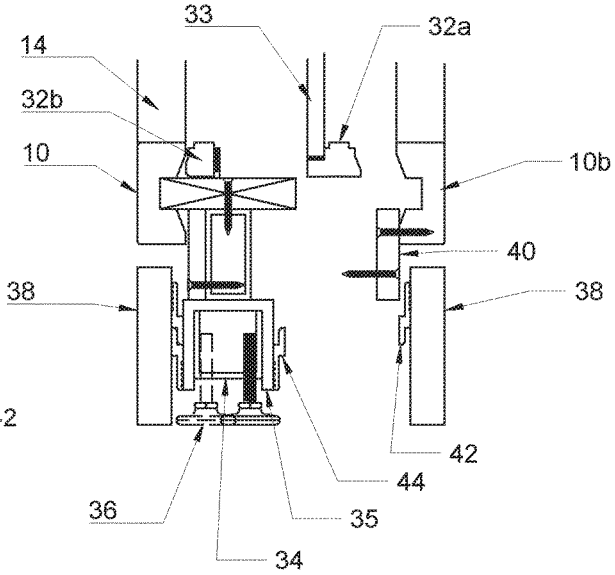
FIG. 12A is a detailed sectional end view of the improved demountable wall system with the panel being removed from the lower support member and vertical framing member constructed according to another embodiment.

FIGS. 12 and 12A depict embodiments of a panel trim assembly 32. Each H-shaped member used to frame the wall panels includes opposed panel-receiving slots or grooves, sized to receive the wall panels. In one embodiment, the thickness of the wall panel will be approximately the same dimension as the slot width, so that the panel can be inserted into the slot. Each H-member may include an inverted tapered interior profile to create a dovetail-like shaped slot in the final assembly. The dovetail-like slot accommodates mating profiled spacers that roll directly into the H-members slots thus eliminating secondary panel frame when desired.

Thinner panels such as glass can be accommodated directly in the H-member profiles with the addition of a roll-in spacer profile. The roll-in spacer profile is removable and preferably matching wood. The described slot in the H-member accommodates both rectangular and tapered profiles due to inverted shape. It will be understood that the term "H-shaped member" is intended to describe the cross-sectional configuration of the support member, and is not intended to suggest any particular orientation of the member.

FIG. 12 represents one configuration where multiple panels are installed in a row. Panel trim assembly members 32*a*, 32*b* are adapted to snap together to retain a panel 33. Panel trim assembly members 32*a*, 32*b* may connect via an angle cut, and the pressure of a gasket keeps the two panel trim assembly members in place with the panel 33.

As also seen in FIG. 12, panel trim assembly members 32*a*, 32*b* may connect to framing member 10. The panel 33 may be removed by initially removing a panel trim assembly member 32*b* and tilting the panel 33 in the space previously occupied by panel trim assembly 32*b* to remove the panel 33 from the framing member 10.

FIG. 12A is another configuration applicable where a panel 33 is installed with an intermediate vertical framing member 14. In this embodiment, each framing member have cross-sections comprising a first member and a second member adapted to combine longitudinally to form the framing member. As seen in FIG. 12A, the panel 33 may be removed by splitting the framing members 10 and 14 into their respective first and second members. A filler piece of wood 40 may be used to mount framing member 10 to mounting member 35. A clip attachment 42 may also be used to remove the cladding 38 from the mounting member 35. Once the first and second members of the framing members are separated, the panel 33 may be removed.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A demountable wall system comprising:

(a) a plurality of framing members said framing members comprising two piece longitudinal members adapted to combine to form said framing members wherein at least one of which is removable, said plurality of framing members including a horizontal lower framing member having upper and lower slots, a horizontal upper framing member having upper and lower slots, and vertical framing members having opposed side slots;

(b) at least one vertical rectangular panel having a lower edge inserted into the upper slot of said lower member, an upper edge inserted into the lower slot of said upper member, and side edges inserted into facing slots of said side members; and (c) a mounting member having opposed sides, an upper edge and a lower edge, said upper edge being fitted into the lower slot of said lower member, and (d) a removable panel trim assembly comprising a panel trim installed onto each edge of said vertical rectangular panel, wherein a lower edge of said panel trim assembly is inserted into the upper slot of said lower member, an upper edge of said panel trim assembly inserted into the lower slot of said upper member, and side edges of said panel trim assembly inserted into facing slots of said side members, whereby one of said longitudinal members adapted to combine to form said framing members may be removed and said vertical panel may then be installed or uninstalled.

2. The demountable wall system of claim 1 further including a structural grid assembly fitted into the upper slot of said upper member adapted to increase the stability of the wall system.

3. The demountable wall system of claim 2, wherein said structural grid assembly is comprised of an extrusion with contoured grooves on an exterior surface and on an interior surface of said extrusion, said contoured grooves adapted to receive an attachment.

4. The demountable wall system of claim 3, wherein said extrusion is comprised of three extruded aluminum profiles including two side extrusions and a bottom extrusion.

5. The demountable wall system of claim 3, wherein said attachment is a cladding attached to said contoured grooves on said exterior surface of said extrusion.

6. The demountable wall system of claim 3, wherein said attachment is a panel track attached to said contoured grooves on said interior surface of said extrusion.

7. The demountable wall system of claim 6 further including a sliding panel having an upper edge inserted into the panel track, said sliding panel having an open configuration and a closed configuration wherein said sliding panel moves between said open configuration and said closed configuration by sliding parallel with respect to a horizontal framing member.

8. The demountable wall system of claim 7 further including a panel filler for attaching said sliding panel to said framing member.

9. The demountable wall system of claim 7 further including a panel guide adapted to retain said sliding panel on said panel track and prevent said sliding panel from tilting when sliding between said open configuration and said closed configuration.

10. The demountable wall system of claim 9, wherein said panel guide is attached to said mounting member.

11. The demountable wall system of claim 2 further including a wiring conduit adapted for concealing wires.

12. The demountable wall system of claim 11, wherein said wiring conduit is comprised of an aluminum box for housing wires.

13. The demountable wall system of claim 11 further including a clip attachment for attaching said mounting member onto said wiring conduit.

14. The demountable wall system of claim 1 further including horizontal cover plates releasably attached to the opposed sides of said mounting member.

15. The demountable wall system of claim 1 further including a wall panel inserted into the panel trim assembly.

16. The demountable wall system of claim 15, wherein said wall panel is comprised of glass having outer edges inserted into slots of said panel trim assembly.

17. The demountable wall system of claim 15, wherein said wall panel is comprised of a rectangular outer frame, said outer frame having outer edges inserted into slots of said removable panel trim assembly, and a center section mounted in said outer frame.

18. The demountable wall system of claim 17, wherein said rectangular outer frame is wood and said center section is glass.

19. The demountable wall system of claim 15, wherein said wall panel is comprised of an upper panel section having a lower edge and a lower panel section having an upper edge, said wall further including an intermediate horizontal framing member with opposed upper and lower slots between said upper and lower panel sections, the lower edge of said upper panel section being inserted into the upper slot of said intermediate framing member, and the upper edge of said lower panel section being fitted into the lower slot of said intermediate framing member.

20. The demountable wall system of claim 1 further including a detachable cover plate over said vertical framing member.

21. The demountable wall system of claim 1, wherein said vertical rectangular panel is a wood panel.

22. The demountable wall system of claim 1, wherein each panel trim comprises of removable a first trim member and a second trim member.

23. The demountable wall system of claim 22, wherein said first trim member is mounted on a framing member of said plurality of framing members.

24. The demountable wall system of claim 22, wherein each of said framing members have cross-sections comprising a first member and a second member adapted to combine longitudinally and form said framing member wherein said vertical rectangular panel may be inserted in between said first member and said second member of said framing member and said vertical rectangular panel may be removed from said framing member by separating said first member and said second member.

25. The demountable wall system of claim 24, wherein said mounting member is mounted to said vertical frame member.

26. The demountable wall system of claim 25, wherein said mounting member is mounted to said vertical frame member with a filler piece of wood.

27. The demountable wall system of claim 25, wherein said second trim member is mounted on said vertical rectangular panel.

28. A demountable wall system comprising:

(a) a plurality of framing members said framing members comprising two piece longitudinal members adapted to combine to form said framing members wherein at least one of which is removable, said plurality of framing members including a horizontal lower framing member having upper and lower slots, a horizontal upper framing member having upper and lower slots, and vertical framing members having opposed side slots;

(b) at least one vertical rectangular panel having a lower edge inserted into the upper slot of said lower member, an upper edge inserted into the lower slot of said upper member, and side edges inserted into facing slots of said side members;

(c) a mounting member having opposed sides, an upper edge and a lower edge, said upper edge being fitted into the lower slot of said lower member;

(d) a removable panel trim assembly comprising a panel trim installed onto each edge of said vertical rectangular panel, wherein a lower edge of said panel trim assembly is inserted into the upper slot of said lower member, an upper edge of said panel trim assembly inserted into the lower slot of said upper member, and side edges of said panel trim assembly inserted into facing slots of said side members; and (e) a connection system for attaching a pair of said framing members comprising a mounting block, a backer plate adapted to attach to said mounting block, and a connection flange adapted to connect with said mounting block, whereby one of said longitudinal members adapted to combine to form said framing members may be removed and said vertical panel may then be installed or uninstalled.

29. The demountable wall system of claim 28 further including an opening on said mounting block adapted to connect with said connection flange.

30. The demountable wall system of claim 29 further including a mating slug on said connection flange adapted to be inserted into said opening of said mounting block.

31. The demountable wall system of claim 30, wherein said mating slug is secured into said opening with a pin.

32. The demountable wall system of claim 31, further including a center post adapted to connect at least two of said framing members.

33. The demountable wall system of claim 32, wherein said mounting block and said backer plate are installed on one framing member and said connection flange is installed on another framing member or on said center post, said mounting block and said connection flange adapted to connect one framing member to another framing member or to said center post.

34. The demountable wall system of claim 33, wherein said mounting block and said backer plate are installed on a horizontal framing member.

35. The demountable wall system of claim 33, wherein said connection flange is installed on said center post.

36. The demountable wall system of claim 35, wherein said center post comprises four faces whereby at least two faces each include one connection flange.

37. The demountable wall system of claim 28, wherein said plurality of framing members are H-shaped.

* * * * *